US005555805A

United States Patent [19]

Lapp

[11] Patent Number: 5,555,805

[45] Date of Patent: Sep. 17, 1996

[54] PRINTING UNIT FOR A WEB-FED PRINTING MACHINE

[75] Inventor: Joachim A. H. Lapp, Margetshochheim, Germany

[73] Assignee: De La Rue Giori S.A., Lausanne, Switzerland

[21] Appl. No.: 510,556

[22] Filed: Aug. 2, 1995

Related U.S. Application Data

[63] Continuation-in-part of Ser. No. 301,489, Sep. 7, 1994.

[51] Int. Cl.[6] ..... B41F 5/04; B41F 13/02

[52] U.S. Cl. ..... 101/228

[58] Field of Search ..... 101/228, 219, 101/227, 224, 231, 216, 485, 486, 181, 178, 138, 143; 226/143, 153

[56] References Cited

U.S. PATENT DOCUMENTS 3,548,747 12/1970 D'Amato ..... 101/228 X 5,109,767 5/1992 Nyfeler et al. ..... 101/228 X

*Primary Examiner*—J. Reed Fisher

*Attorney, Agent, or Firm*—Kane, Dalsimer, Sullivan, Kurucz, Levy, Eisele and Richard, LLP

[57] ABSTRACT

The printing unit has two cooperating cylinders (1, 4) which form the printing nip and which have printing saddles (2, 5) separated by cylinder pits (3, 6). The paper web (7) passing through the printing nip is transported in the pilgrim-step mode, in order to print formats adjoining one another. The two cylinders (1, 4) are angularly adjustable relative to one another, in respect of the position of their printing saddles (2, 5) cooperating in the printing nip, in a manner offset by the amount of a circumferential distance which is approximately equal to the difference between the circumferential length (S) of a printing saddle and the circumferential length (B) of a printing image. The impression zone is therefore only approximately as large as the printing image, and the impression-free zone available for retracting the paper web is correspondingly enlarged.

2 Claims, 3 Drawing Sheets

PRINTING UNIT FOR A WEB-FED PRINTING MACHINE

The present patent application is a continuation-in-part of the patent application Ser. No. 08/301,489 filed on Sep. 7, 1994.

FIELD OF THE INVENTION

The invention relates to a printing unit for a web-fed printing machine with two cooperating cylinders which form the printing nip and which, as in a sheet-fed printing unit, have a plurality of printing saddles separated by cylinder pits, for printing a web running through the printing nip with variable formats adjoining one another, the web being transported at a variable speed in the so-called pilgrim-step mode and, after each printing operation, when it passes a cylinder pit, being retracted and accelerated again relative to the circumference of the two cylinders in such a way that successive printing images are lined up virtually without a gap.

PRIOR ART

Printing units of this type are described in U.S. Pat. No. 5,062,360. These known printing units are either offset printing units with two cooperating blanket cylinders, which are both inked with printing images and which serve for producing a recto/verso print, or intaglio printing units with a plate cylinder which cooperates with an impression cylinder. The use of sheet-fed printing units for printing a continuous paper web has the advantage that there is no need for the difficult and time-consuming production of plate and impression or blanket cylinders with a continuous seamless circumferential surface; use is made, instead, of the cylinders which are simpler to produce and have printing saddles separated from one another and on which the individual printing plates or printing coverings can be individually mounted, adjusted and exchanged without great difficulty. Moreover, the transport of the paper web in the so-called pilgrim-step mode affords the possibility that images adjoining one another can always be produced without a loss of paper as a result of unprinted gaps between the images, hence that no unprinted strips occur between successive printing images on account of the cylinder pits. For this purpose, as described particularly in U.S. Pat. No. 5,062,360, the transport of the paper web is controlled by means of a control system in such a way that, after each printing operation, the no longer clamped paper web, when it passes the mutually aligned cylinder pits of the two cylinders, is first braked, then moved backward and finally accelerated again to the operating speed, before it is clamped once more between the following cooperating printing saddles of the two cylinders for the subsequent printing operation. The distance over which the paper web is retracted relative to the circumference of the two cylinders is selected so that successive printing images are printed virtually without a gap. To this effect, therefore, the pilgrim-step movement must be controlled in such a way that, after the pilgrim step, the paper web assumes at least approximately the same position relative to the printing nip between the two cylinders, that is to say within the machine, as before the pilgrim step.

As a result of an appropriate adaptation of the pilgrim-step movement, it is possible, with one and the same printing machine, even in the case of varied formats of the printed image, that is to say in the case of shorter formats, to print images adjoining one another without a gap. The printing format is changed by mounting a printing plate of the same size with a shorter printing image, the impression zone thus remaining the same and not being shortened.

In the hitherto known web-fed printing machines of this type, the two cylinders are always set relative to one another in such a way that the printing saddles, when they cooperate in the printing nip, are located exactly opposite one another, as shown in FIGS. 1 and 2 for the two cylinders 1 and 4 which each have three printing saddles 2 and 5 with the circumferential length S. At the same time, therefore, the length D of the impression zone, along which the paper web 7 is clamped between the two cylinders, is always exactly as large as the circumferential length S of a printing saddle, specifically irrespective of the circumferential length B of the printing image, that is to say of the format.

The impression-free zone between two impression zones according to the length G of a cylinder pit and consequently the timespan available for retracting the paper web are therefore, of course, also always the same.

FIG. 1 shows the commencement of a printing operation and FIG. 2 the end of this printing operation, that is to say after the cylinders have rotated in the direction of the arrows through an angle corresponding to the length D of the impression zone. If the maximum possible format is being printed, that is to say if the circumferential length of the printing image is virtually equal to the circumferential length of a printing saddle, then, after each printing operation, the paper web 7, when it passes the cylinder pits 3, 6 in a freely movable manner, must be braked, retracted and accelerated again in such a way that, depending on the printing speed, the obtainable deceleration and acceleration and the time taken to run through the pit, when printing commences again it assumes approximately the same position relative to the printing nip as that which it had assumed before the pilgrim step.

However, if smaller formats are to be printed, in which, as illustrated in FIGS. 1 and 2, the circumferential length B of a printing image is smaller than the circumferential length S of a printing saddle, then, after each printing operation, the paper web 7 must be retracted and accelerated again over a greater distance which ensures that, when impression commences again, the position of the paper web is additionally set back relative to the printing nip, opposite to the running direction, by the amount of the difference between the length of the impression zone D and the length B of the printing image, that is to say by the amount of the distance D–B.

In an example according to FIGS. 1 and 2, the impression start A coincides with the image beginning, while the impression end E of the impression zone is located behind the image end F by the amount of said distance D–B, this difference being designated by Z. In this case, therefore, whenever impression commences again, the paper web 7 must assume a position relative to the printing nip which is offset rearward opposite to the running direction by the amount of the length Z, if printing images succeeding one another virtually without a gap are to be obtained on the paper web, as indicated in FIG. 1.

The fact that the length D of the impression zone always remains constant, even when printing images of smaller format are produced, has various disadvantages:

Since, after each printing operation, the paper web must additionally be retracted by the amount of a distance Z, this signifies, for smaller formats, that is to say for larger Z, a considerably greater deceleration and acceleration of the paper web in comparison with the printing mode in which the maximum printing format is produced. At the same time, the following has to be taken into account:

When the paper web is released after the impression zone, it first moves a little way further according to the magnitude of the printing speed and of the obtainable deceleration, until it stops. This distance which the paper web has thereby covered is doubly critical, since it has to be taken into account once again during acceleration after the standstill of the paper web. The paper web therefore has to be retracted by double this distance, so that, after subsequent acceleration, it arrives again with the printing speed at the same point which it occupied before the pilgrim step.

If the printing-saddle length is larger than the printing-image length, the paper web cannot be decelerated immediately after the end of the printing image, but is transported further at the printing speed, before the pilgrim step can commence. As mentioned, this distance must be covered additionally in the pilgrim step.

However, since limits are placed on the deceleration and acceleration of the paper web, a reduction in the speed of the machine is necessary. This loss of capacity thus has a twofold effect, since, during each revolution, a shorter printing image is produced and, in addition, the speed must be reduced Furthermore, particularly in intaglio printing, the paper web is compacted by the very high pressure, which can amount to 80 metric tons per meter of web width, and by the high-gloss chromium-plated surface of the printing plate, in such a way that after retraction, during the subsequent printing operation, the pressed, but not ink- printed portion Z of the paper web is printed with poorer quality than the non-pressed web. FIGS. 1 and 2 illustrate the excessively pressed web portion Z and the double-pressed portion P. The pressing of the portion Z in FIG. 1 originates from the preceding printing operation.

SUMMARY OF THE INVENTION

According to the present invention in an aforementioned web-fed printing machine the two cooperating cylinders are set angularly relative to one another, in respect of the position of their printing saddles cooperating in the printing nip, depending on the format, in a manner offset by the amount of a circumferential distance which is at least approximately equal to the difference between the circumferential length of a printing saddle and the circumferential length of a printing image, so that the length of the impression zone, along which two printing saddles clamp the web between them when they pass the printing nip, is only at least approximately as large as the circumferential length of a printing image, wherein a first release member is fastened to the circumference of a first cylinder in which the beginning of a printing saddle corresponds to the beginning of the printing image in relation to the direction of rotation of the cylinder, and a first sensor activatable by this release member is installed in proximity to the circumference of this cylinder, wherein a second release member is fastened to the circumference of the second cylinder in which the end of a printing saddle corresponds to the end of the printing image, and a second sensor activatable by this release member is installed in proximity to the circumference of said second cylinder, and wherein said release members and sensors are arranged and designed in such a way that the first sensor generates a first signal at the moment at which the beginning of a printing saddle of the first cylinder passes the connecting line between the axes of the two cylinders, and the second sensor generates a second signal at the moment at which the end of the printing saddle of the second cylinder cooperating with the printing saddle of the first cylinder passes said connecting line, said signals and the time span between the two signals representing measured quantities for the angular position and the circumferential length of the impression zone and serving for controlling the movement of the paper web in the pilgrim-step mode when it passes a impression-free zone.

In this way a printing unit is realized in which no losses of capacity during the transition to a smaller format and also no double pressings of the paper web occur, and in which electric signals corresponding to the position and the length of impression zone are produced automatically in order to control the pilgrim-step movement of the paper web.

BRIEF DESCRIPTION OF THE DRAWINGS

The invention is explained in more detail by means of an exemplary embodiment with reference to the drawings.

As already mentioned.

DESCRIPTION OF THE PREFERRED EMBODIMENT

Figure 3:
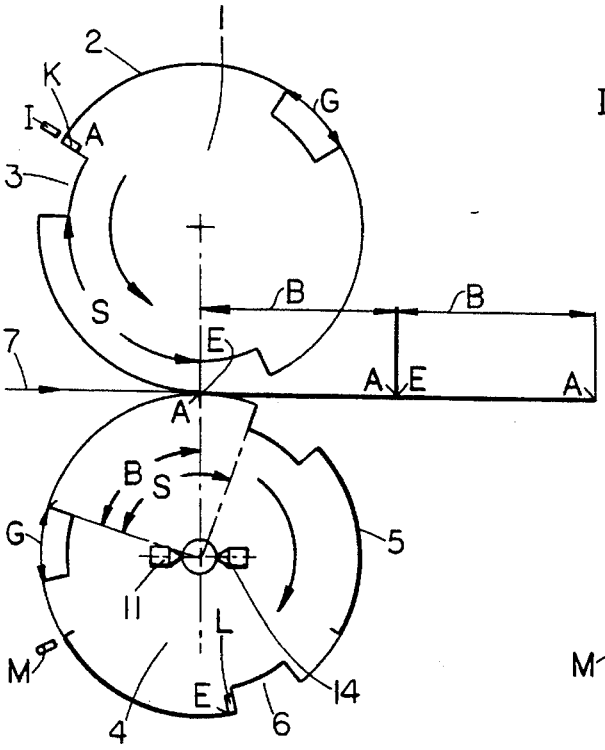
FIGS. 3 and 4 illustrate a printing unit according to the invention and its operation, FIG. 3 showing the commencement of a printing operation and FIG. 4 the end of this printing operation, that is to say after the two cylinders have rotated through an angle corresponding to the impression zones D.
Figure 4:
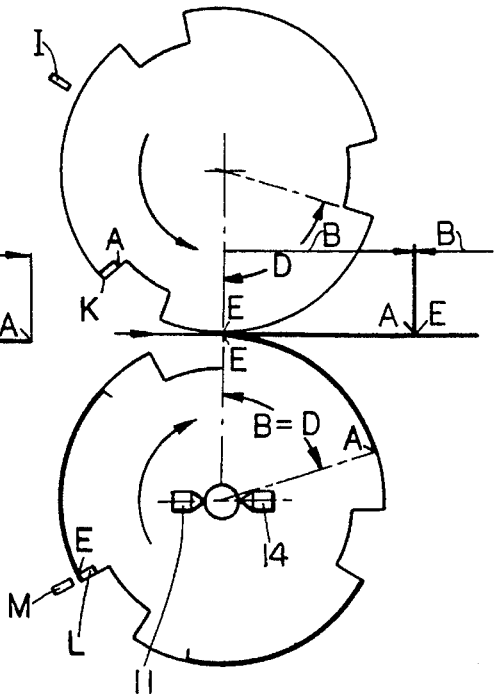

The two cylinders 1 and 4 illustrated in FIGS. 3 and 4 are, for example, the plate cylinder 4 and the impression cylinder 1 of an intaglio printing unit. The direction of rotation of the cylinders is indicated by curved arrows. The two cylinders have three printing saddles 2 and 5 of equal size and with the circumferential length S which are arranged equally distantly along their circumference and which are separated from one another by cylinder pits 3 and 6 with the circumferential length G. Printing coverings are mounted on the printing saddles 2 of the impression cylinder 1 and intaglio printing plates are mounted on the printing saddles 5 of the plate cylinder 4. The printing image on the printing plates has a circumferential length B which is smaller than the length S of the respective printing saddle 5.

In the example under consideration, the printing plates are mounted in such a way that the end E of the printing image coincides with that end of the printing saddle 5 at the rear in the direction of rotation, while the beginning A of the printing image is offset correspondingly relative to the beginning of the printing saddle 5. As illustrated, the impression cylinder 1 is set angularly relative to the plate cylinder 4 so that the printing saddles 2 and 5 cooperating in the printing nip and belonging to the two cylinders are offset relative to one another in such a way that the circumferential length D of the impression zone, in which the cooperating printing saddles clamp the paper web 7, exactly includes only the format to be printed, that is to say the circumferential length B of the printing image. In practice, of course, the impression zone must be slightly longer than the printing image so as to allow for the free edges of the printing images applied to the paper web.

According to FIGS. 3 and 4, the end of the printing saddle 2 of the impression cylinder 1 at the front in the direction of rotation is offset relative to the front end of the printing saddle 5 by an amount which is equal to the difference S–B. As mentioned, in practice, the size of this offset is very slightly smaller.

Since, during the printing operation, as a result of this arrangement of these two cylinders 1 and 4, the clamping region of the web is shortened essentially to the circumferential length B of the format to be printed and consequently the impression-free zone is enlarged to the length G+(S–B), more time is available for retracting the paper web, that is to say for deceleration and acceleration. Moreover, the paper web does not need to be additionally retracted, since it is freed immediately after the end of the printing image and can be decelerated. It is therefore essential that the paper web be clamped only directly before the beginning A of the printing image and be freed again immediately after the end E of the printing image. The advantage of this is that, in the case of constant deceleration and acceleration moments which are drive-related, the machine speed can be increased by means of the lengthened impression-free zone. The shorter repeat length in the case of a small printing image can therefore be compensated by a higher speed. The smaller the length B of the printing image, the larger the impression-free zone which is available for retracting the correspondingly large paper-web portion.

Figure 1:
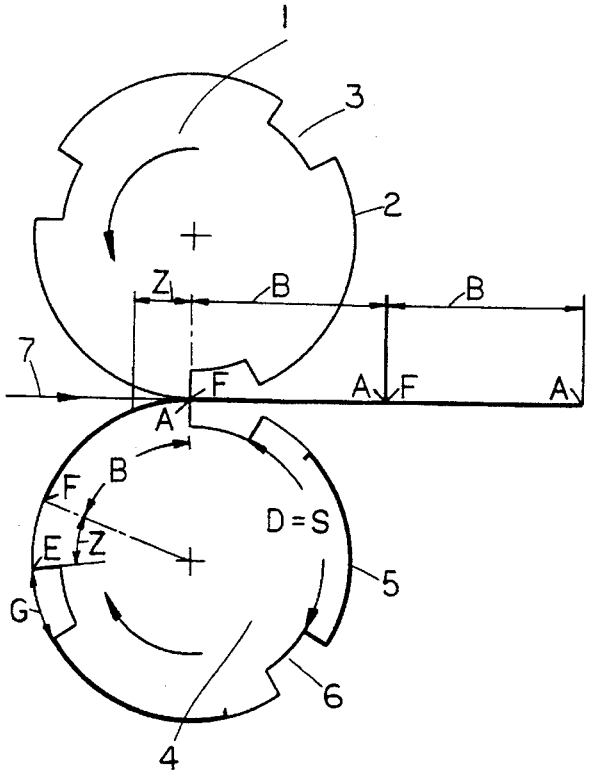
FIG. 1 PRIOR ART
FIGS. 1 and 2 illustrate the printing operation of a known sheet-fed printing unit during the printing of a paper web which is transported in the pilgrim-step mode.
Figure 2:
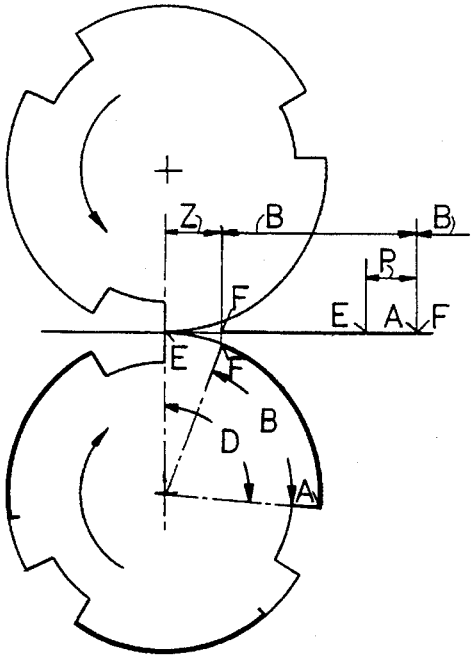
FIG. 2 PRIOR ART

A further advantage is that, during a printing operation, no additional paper-web portion is pressed outside the printing image and therefore double pressing according to the doubly pressed portion P of the paper web according to FIG. 2 is absent, thereby preventing the quality from being impaired.

In the example according to FIGS. 3 and 4, the cylinder 1 could also be the plate cyclinder and the cylinder 4 the impression cylinder. In this case, the beginning A of the printing image coincides with the end of the printing saddle of the plate cylinder at the front in the direction of rotation, and it is this plate cylinder which is offset opposite to the direction of rotation in relation to the impression cylinder.

In order to utilize fully the above-described advantageous effects of an offset of the two cooperating cylinders, therefore, the printing image on a printing plate must either with its beginning A coincide with the beginning of the respective printing saddle or else with its end E coincide with the end of the respective printing saddle.

The embodiment illustrated in FIGS. 3 and 4 can also be an offset printing unit with two cooperating blanket cylinders, by means of which either a one-sided offset print can be produced with an inking of only one blanket cylinder or a recto/verso print can be produced with an inking of both blanket cylinders. All the advantages mentioned above also apply to an offset printing unit of this type.

The length D of the impression zone and its angular position which corresponds to the relative angular displacement between the printing saddles of the two cylinders 1 and 4 are adjusted before the beginning of the printing operation. During this printing operation electrical signals which represent said length D of the impression zone and said angular position, are needed in order to command the known control system for the pilgrim-step-movement of the paper web as it has been already mentioned and described in U.S. Pat. No. 5,062,360. According to the present invention, during the printing operation these electric signals are produced automatically by measuring the relevant quantities. For this purpose, in the example according to FIGS. 3 and 4, a release member K is fastened to the circumference of the impression cylinder 1 in such a way that it moves past a fixedly installed sensor or proximity detector I, responding to this member, exactly when the beginning of the impression zone, that is to say the beginning A of the printing image, passes the connecting line between the axes of the two cylinders 1 and 4; this position is shown in FIG. 3.

A release member L is likewise fastened to the plate cylinder 5 in such a way that it passes a fixedly installed sensor or proximity detector M exactly at the moment when the end of the impression zone D of the plate cylinder, that is to say the end E of the printing image, passes said connecting line; this position is shown in FIG. 4. The sensors I and M can, for example, be inductive or optical sensors, in the case of an inductive sensor, the release member K or L being, for example, a steel block.

Figure 5:
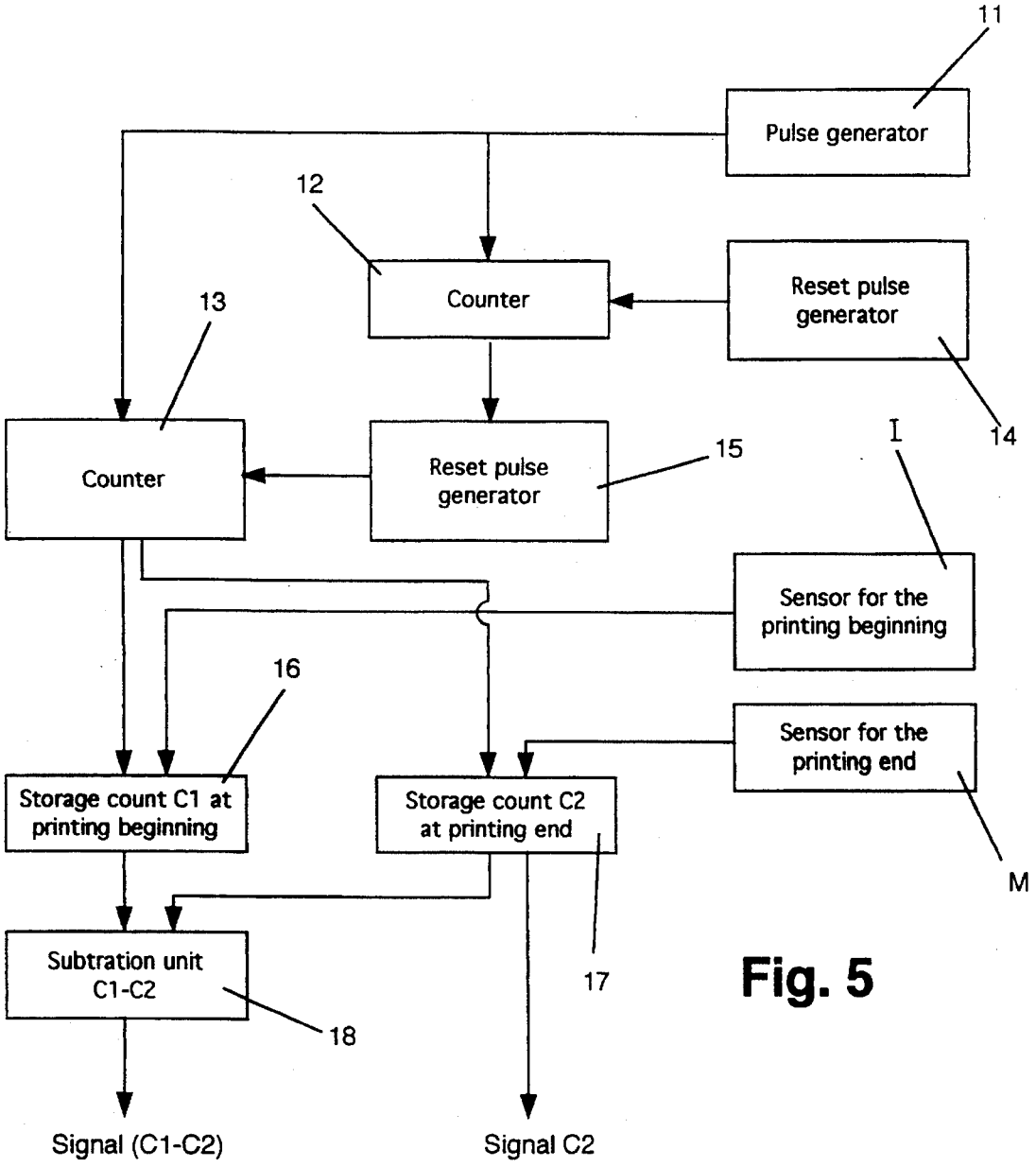
FIG. 5 is a block diagram illustrating the processing of the count pulses of the shaft encoder of the plate cylinder.

A block diagram of the system is provided for the electronic determination of the length and the angular position of the impression zone used in the embodiment of FIGS. 3 and 4 is represented in FIG. 5. A shaft encoder in form of a pulse generator 11, that has been fastened to the shaft of one of both cylinders 1 and 4, for example of the plate cylinder 4, sends pulses representing the rotary angle of the cylinder to two counters 12 and 13 incremented by them. Since both cylinders 1 and 4 coupled by toothed weels, rotate in synchronism, it is sufficient to measure the rotation of only one cylinder.

Figure 6:
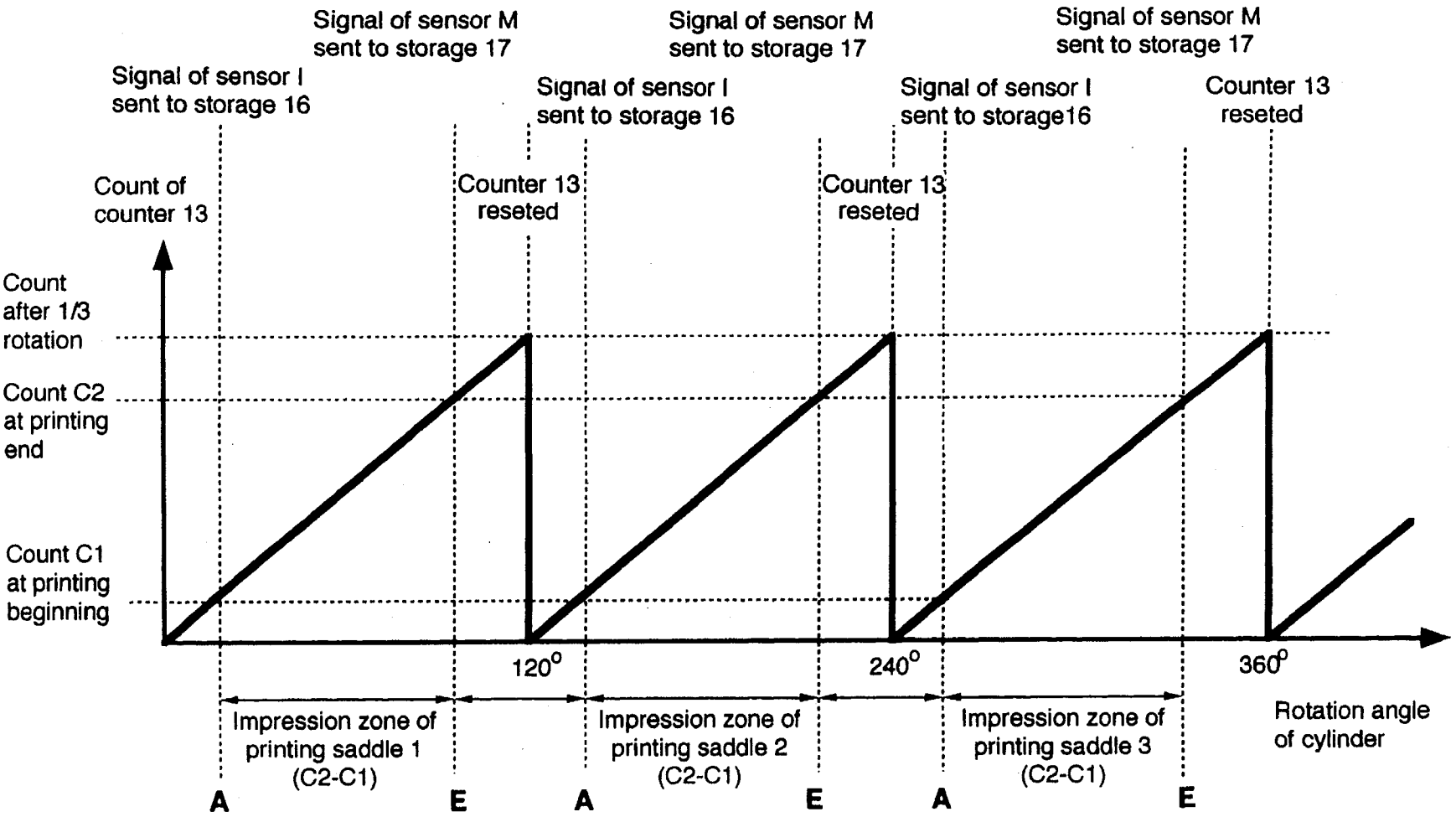
FIG. 6 is a count diagram of the counts of counter 13 of FIG. 5.

Another shaft encoder in form of a reset pulse generator 14 is also connected to cylinder 4 to reset the counter 12 after each rotation of 360° of the plate cylinder. The output of counter 12 is connected to another reset pulse generator 15 which produces a reset pulse whenever the cylinders have made a rotary movement of 360°/N, whereby N is the number of printing saddles of the cylinder, that is the number of printing plates of plate cylinder 5. According to the embodiment considered, N is 3, so that the reset pulse generator 15 produces a reset pulse every 120°. These reset pulses are transmitted to the counter 13, which is therefore resetted every 120°, that means after each termination of one printing process, as it is shown in FIG. 6. FIG. 6 represents the count of counter 13 over the rotation angle of the cylinders.

When the release member K of the impression cylinder 1 moves past the sensor I at the printing beginning, as it is shown in FIG. 3, it generates a signal sent to a storage 16 which stores at this moment the count C1 of the counter 13. C1 represents the printing beginning. When the release member L of the plate cylinder 5 moves past the sensor M at the printing end, as it is shown in FIG. 4, it generates a signal sent to a storage 17 which stores at this moment the count C2 of the counter 13. C2 represents the printing end. The above described pulse treatment is illustrated in FIG. 6. It illustrates that the counter 13 is incremented by the pulse generator 11 and after each rotation of 120° of the cylinder is resetted by the reset pulse generator 15 controlled by the counter 12. At each printing beginning A the count C1 of the counter 13 is stored in the storage 16, and at each printing end E the count C2 of counter 13 is stored in the storage 17.

The count values C1 and C2 are sent to a subtracting unit 18 (FIG. 5) which subtracts the count C2 from the count C1. The difference value (C2–C1) resulting from this subtracting is a measure of the length D of the impression zone actually effective and therefore of the impression-free zone, in which the paper web is free.

The count value C2 and the difference (C2–C1) determine therefore the angular position and the length of the impression zone which are used to command the control system for the pilgrim-step-movement of the paper web in order to guarantee a gap-free printing of the web.

Therefore, the two signals and the time span between the two signals represent measured quantities which, at a given rotational speed of the cylinders 1 and 4, determine respectively the angular position and the length of the impression zone.

I claim:

1. A printing unit for a web-fed printing machine comprising:

a first cylinder (1) and a second cylinder (4) cooperating together and forming a printing nip and cylinder pits (3,6), said first and second cylinders each have an axis, said first and second cylinders (1, 4) include a plurality of printing saddles (2, 5) separated by said cylinder pits (3, 6), said printing saddles (2, 5) cooperate together to form an impression zone for printing having a circumferential length D, said first and second cylinders (1, 4) being offset angularly relative to one another, in respect of the position of their printing saddles (2, 5) in order that the circumferential length D of the impression zone is adapted to a circumferential length (B) of a printing image, whereby the web is transported at a variable speed in a so called pilgrim step mode which means that after each printing operation, when the web passes a cylinder pit (3, 6) it is retracted and accelerated again relative to the first and second cylinders (1, 4), in such a way that successive printing images are lined up virtually without a gap;

first and second release members (K, L) and first and second sensors (I,M) intended to control movement of the web, said first release member (K) being fastened to the circumference of said first cylinder (1), said first sensor (I) activatable by the release member (K) and being installed in proximity of this first cylinder (1), one of said plurality of saddles (2) having a beginning (A) of the printing image in relation to the direction of rotation of the cylinders (1, 4), said first release member (K) and said first sensor (I) are arranged in order that said sensor (I) generates a signal at the moment at which the beginning of a printing saddle (2) of the first cylinder (1) passes a connecting line between the axes of the first and second cylinders (1, 4), whereby the signal of this sensor (I) indicates the beginning of the printing, said second release member (L) being fastened to the circumference of said second cylinder (4), said second sensor (M) being installed in proximity of this second cylinder (4), a printing saddle (5) of said plurality of saddles having an end corresponding to the an end (E) of the printing image in relation to the direction of rotation of the first and second cylinders (1, 4), said second release member (L) and second sensor (M) are arranged in order that said sensor (M) generates a second signal at the moment at which the end of a printing saddle (5) of the second cylinder (4) passes the connecting line between the axes of the first and second cylinders (1, 4), whereby the signal of sensor (M) indicates the end of the printing; and means for processing said signals of said sensors (I, M) and for obtaining signals corresponding to the circumferential length of the printing image signal C2–C1 and the moment of the printing end (signal C2).

2. The printing unit of claim 1 wherein said means for processing the signals of the sensors (I, M), comprises:

a shaft encoder in form of a pulse generator (11) fastened to the shaft of one of both cylinders which sends pulses representing the rotary angle of the cylinders;

a counter (13) receiving said pulses of the pulse generator (11);

means (16, 17) for storing the count (C1) of said counter (13) by a signal of the first sensor (I) activated in the moment when a printing begins;

means for storing the count (C2) of said counter (13) by a signal of the second sensor (M) activated in the moment when a printing ends, and for generating a signal corresponding to said count (C2);

a subtraction unit (18) for producing a signal (C2–C1);

means (12, 14, 15) for resetting said counter (13) whenever the cylinders (1, 4) have made a rotary movement of 360°/N, N being the number or printing saddles (2, 5) of the cylinders (1, 4).

* * * * *